US012577714B2

(12) United States Patent
Kongo

(10) Patent No.: US 12,577,714 B2
(45) Date of Patent: Mar. 17, 2026

(54) SEWING DATA CREATION DEVICE, PROGRAM, AND SEWING MACHINE

(71) Applicant: JANOME Corporation, Tokyo (JP)

(72) Inventor: Takeshi Kongo, Tokyo (JP)

(73) Assignee: Janome Corporation, Tokyo (JP)

( * ) Notice: Subject to any disclaimer, the term of this patent is extended or adjusted under 35 U.S.C. 154(b) by 0 days.

(21) Appl. No.: 18/799,225

(22) Filed: Aug. 9, 2024

(65) Prior Publication Data

US 2025/0051983 A1 Feb. 13, 2025

(30) Foreign Application Priority Data

Aug. 10, 2023 (JP) ..... 2023-131278

(51) Int. Cl.
*D05B 19/12* (2006.01)
*D05B 19/10* (2006.01)

(52) U.S. Cl.
CPC ..... *D05B 19/12* (2013.01); *D05B 19/10* (2013.01)

(58) Field of Classification Search
CPC ..... D05B 19/08; D05B 19/10; D05B 19/12; D05C 5/00; D05C 5/02
USPC ..... 700/136–138
See application file for complete search history.

(56) References Cited

U.S. PATENT DOCUMENTS 9,194,068 B2 11/2015 Okuyama et al.
11,475,016 B1 * 10/2022 Wolz ..... G06N 20/00
2015/0128837 A1 5/2015 Okuyama et al.
2022/0403574 A1 * 12/2022 Tsuchiya ..... D05B 19/10

FOREIGN PATENT DOCUMENTS

JP 2015093126 A 5/2015

* cited by examiner

*Primary Examiner* — Nathan E Durham
(74) *Attorney, Agent, or Firm* — Muncy, Geissler, Olds & Lowe, P.C.

(57) ABSTRACT

A sewing data creation device includes: a display control unit that causes a touch panel display to display an edit screen including a rendering region for displaying multiple needle drop points forming sewing data; a needle drop point identifying unit that identifies a user-selected needle drop point as a target needle drop point; a touch detecting unit that detects contact of an instructing member with a position in the edit screen other than the target needle drop point with the target needle drop point being identified; a needle drop point moving unit that moves the position of the target needle drop point in the rendering region to be linked with motion of the instructing member being in contact with the edit screen; and a needle drop point finalizing unit that, when the contact of the instructing member is no longer detected, finalizes the position of the target needle drop point.

17 Claims, 9 Drawing Sheets

SEWING DATA CREATION DEVICE, PROGRAM, AND SEWING MACHINE

CROSS-REFERENCE TO RELATED APPLICATIONS

This application claims foreign priority benefits under U.S.C. § 119 to Japanese Patent Application No. 2023-131278 filed on Aug. 10, 2023, the contents of which is hereby incorporated by reference in its entirety.

BACKGROUND

1. Technical Field

The present disclosure relates to a sewing data creation device, a program, and a sewing machine.

2. Description of Related Art

For example, Japanese Patent Application Laid-Open No. 2015-93126 discloses a sewing machine having a function of generating and editing sewing data used for sewing patterns in accordance with a user instruction. Specifically, Japanese Patent Application Laid-Open No. 2015-93126 discloses a sewing machine that can display a pattern including a plurality of needle drop points, an eight-direction cursor button used for adjusting the pattern, and the like on a touch panel and, in response to user operations on the cursor buttons or the like, perform designation, position adjustment, or the like of the needle drop points.

Japanese Patent Application Laid-Open No. 2015-93126 is an example of the related art.

In the sewing machine disclosed in Japanese Patent Application Laid-Open No. 2015-93126, each cursor button displayed on a sewing data edit screen is displayed with a certain size so that the user can operate the cursor button by its finger. This causes a problem of reducing a region for displaying a pattern view being edited.

Further, to solve the above problem, for example, it is conceivable to omit the eight-direction cursor button and allow the user to directly touch a needle drop point by its finger on a pattern view displayed on the touch panel and then move the needle drop point to a desired location. However, since a needle drop point to be edited is displayed on the touch panel as a very small point, there is a problem in that, when the user intends to press and move the needle drop point by its finger, the needle drop point is hidden by the finger and this leads to difficulty in fine adjustment. Further, to solve such an inconvenience, it is conceivable to display an enlarged view of the area around a needle drop point intended to move. In such a case, however, the user may have difficulty in knowing the overview of the pattern and be at a loss in deciding how far the user should move the needle drop point.

BRIEF SUMMARY

The present disclosure has been made in view of such circumstances and intends to provide a sewing data creation device, a program, and a sewing machine that can improve usability in creation and edition of sewing data on a pattern formed of a plurality of needle drop points for embroidery, stitch, or the like.

One aspect of the present disclosure is a sewing data creation device used in a sewing machine and configured to create sewing data having a pattern element, and the sewing data creation device includes: a display control unit configured to cause an edit screen to be displayed on a touch panel display, the edit screen including a rendering region used for displaying the pattern element; a pattern element identifying unit configured to, when the pattern element is selected by a user, identify the selected pattern element as a target pattern element; a touch detecting unit configured to detect contact of an instructing member with a position in the edit screen other than a position of the target pattern element with the target pattern element being identified; a pattern element moving unit configured to move the position of the target pattern element in the rendering region to be linked with motion of the instructing member that is in contact with the edit screen; and a pattern element finalizing unit configured to, when the contact of the instructing member is no longer detected, finalize the position of the target pattern element.

One aspect of the present disclosure is a sewing machine including the sewing data creation device described above.

One aspect of the present disclosure is a program that causes a computer to function as the sewing data creation device described above.

According to the present disclosure, it is possible to achieve an advantageous effect of improving usability in creation and edition of sewing data for embroidery or the like.

DETAILED DESCRIPTION

A sewing data creation device, a program, and a sewing machine according to one embodiment of the present disclosure will be described below with reference to the drawings.

Figure 1:
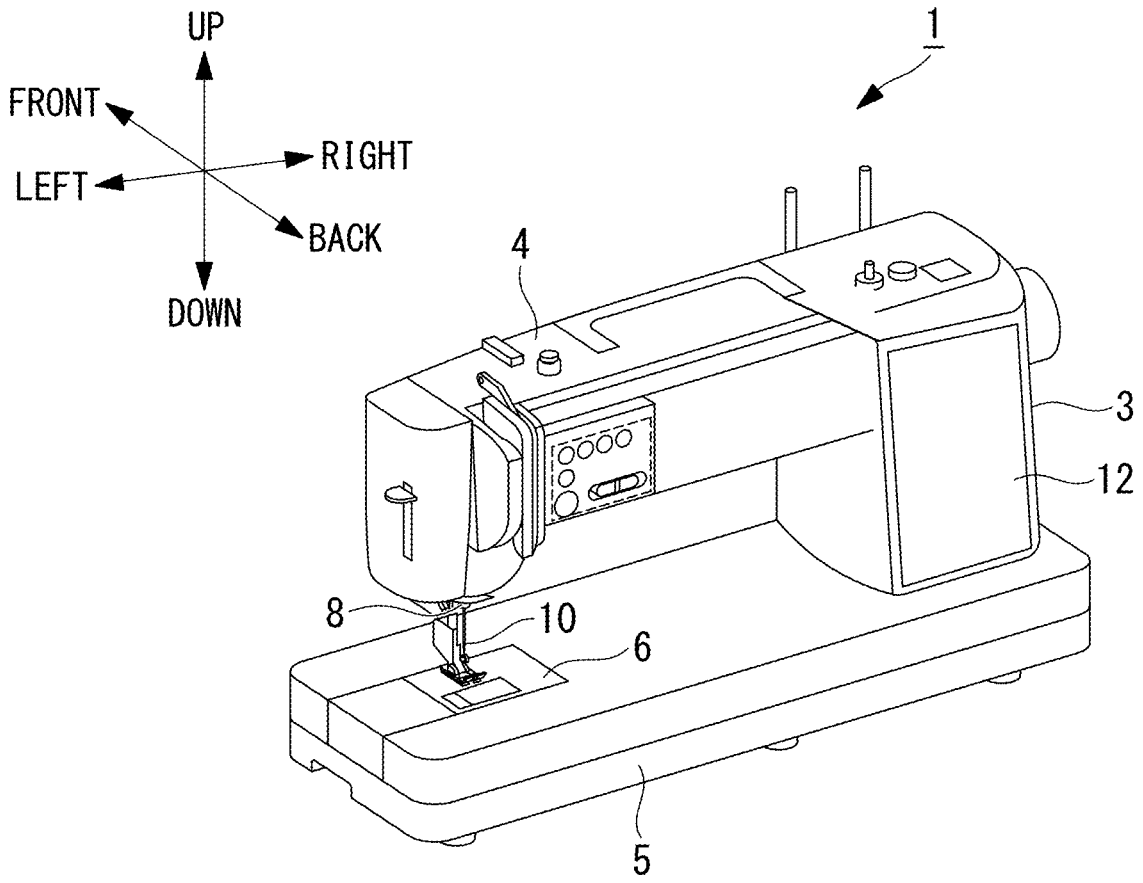
FIG. 1 is a diagram illustrating an example of an external view of a sewing machine according to one embodiment of the present disclosure.

FIG. 1 is a diagram illustrating an example of an external view of a sewing machine 1 according to one embodiment of the present disclosure. The up-down direction, the front-back direction, and the left-right direction that are orthogonal to each other illustrated in FIG. 1 define the up-down direction, the front-back direction, and the left-right direction in a main body of the sewing machine 1, respectively. Further, the up-down direction is also referred to as a needle drop direction. Further, the front-back direction is also referred to as a cloth feed direction, and the left-right direction is also referred to as an amplitude direction.

The sewing machine 1 includes, for example, a stud part 3, an arm part 4, and a bed part 5. The stud part 3 forms the right end of the sewing machine 1 and extends in the up-down direction. The arm part 4 extends from the upper end of the stud part 3 to the left. The bed part 5 extends from the lower end of the stud part 3 to the left.

For example, the top face of the bed part 5 is provided with a throat plate 6 having a needle hole. A feed mechanism 18 (see FIG. 2) having feed dog and a feed motor 16 (see FIG. 2) configured to drive the feed mechanism 18 are provided under the throat plate 6, that is, inside the bed part 5.

The left bottom part of the arm part 4 is provided with a needle bar 8. A sewing needle 10 is detachably attached to the lower end of the needle bar 8. A sewing machine motor 14 (see FIG. 2) for driving and reciprocating the needle bar 8 in the up-down direction and an amplitude motor 15 (see FIG. 2) for moving the needle bar 8 in the left-right direction (amplitude direction) are provided inside the arm part 4.

The front face of the arm part 4 is provided with a touch panel display 12. For example, the touch panel display 12 implements functions as an input unit for the user to provide operation instructions to the sewing machine 1 and as a display unit for providing information to the user. Thus, the touch panel display 12 implements functions as a user interface.

Figure 2:
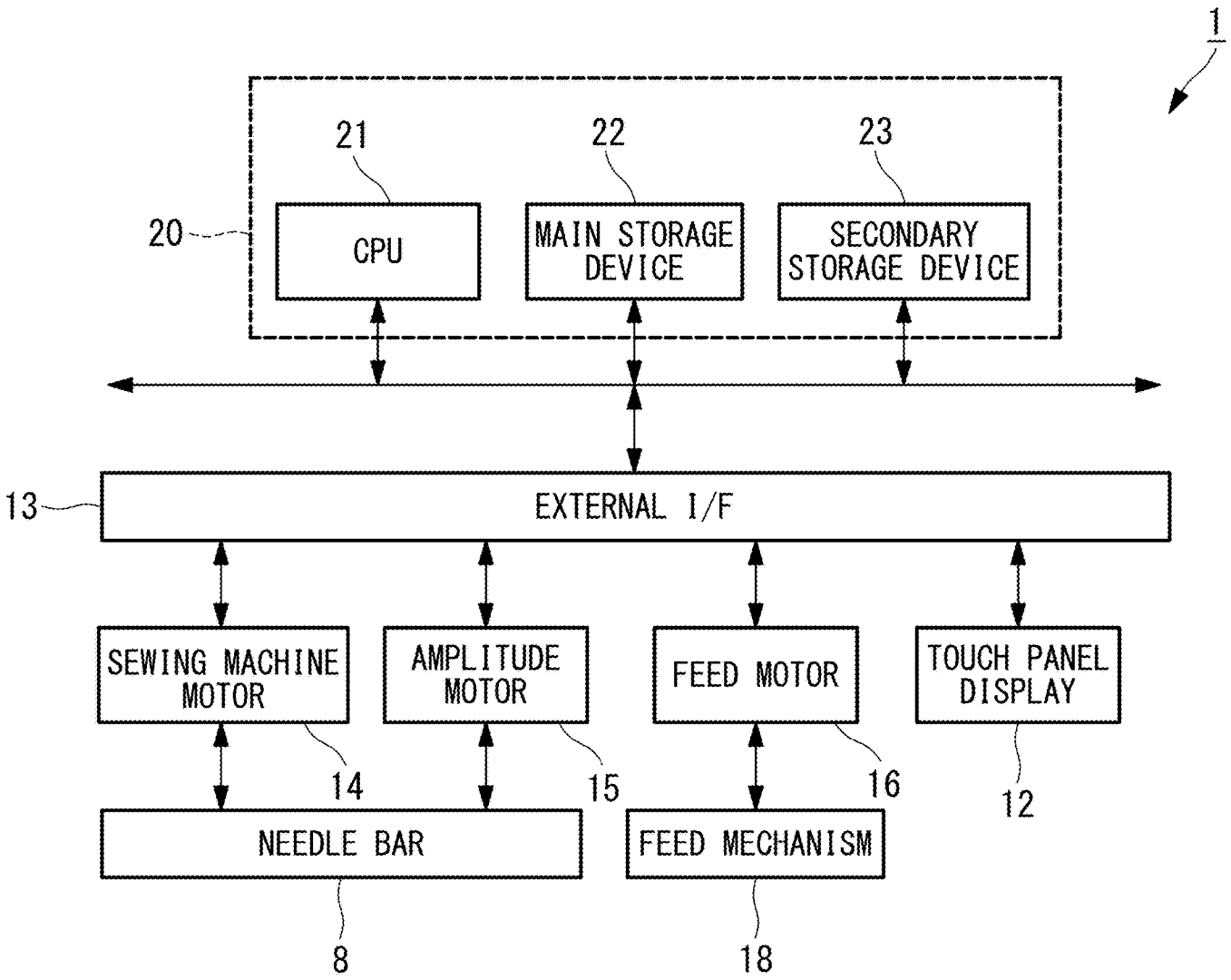
FIG. 2 is a block diagram illustrating an example of an electrical configuration of the sewing machine according to one embodiment of the present disclosure.

Next, the electrical configuration of the sewing machine 1 according to one embodiment of the present disclosure will be described. FIG. 2 is a block diagram illustrating an example of the electrical configuration of the sewing machine 1 according to the present embodiment. As illustrated in FIG. 2, the sewing machine 1 includes a processing circuit (circuitry) 20, for example. The processing circuit 20 includes, for example, a central processing unit (CPU: processor) 21, a main storage device (main memory) 22, a secondary storage device (secondary storage, memory) 23, and the like.

The main storage device 22 is formed of a writable memory such as a cache memory, a random access memory (RAM), or the like, and is used as a working area in which reading of an execution program of the CPU 21, writing of data processed by the execution program, or the like are performed.

The secondary storage device 23 is a non-transitory computer readable storage medium. An example of the secondary storage device 23 may be a magnetic disk such as a hard disk drive (HDD), a magneto-optical disk, a CD-ROM, a DVD-ROM, a semiconductor memory such as a solid state drive (SSD), or the like.

For example, the secondary storage device 23 stores control programs used for implementing each of a plurality of sewing modes for normal sewing, applique sewing, embroidery sewing, free motion, or the like. Further, the secondary storage device 23 stores data referenced for implementing various sewing modes, for example, a plurality of sewing data used for sewing patterns or the like. Further, the secondary storage device 23 stores a sewing data creation program used for newly creating sewing data and editing sewing data.

Further, the processing circuit 20 is connected to respective drive units, the touch panel display 12, and the like forming the sewing machine 1 via an external interface 13. For example, the touch panel display 12, the sewing machine motor 14 for reciprocating the needle bar 8 in the up-down direction, the amplitude motor 15 for moving the needle bar 8 in the left-right direction (amplitude direction), and the feed motor 16 for driving the feed mechanism 18 configured to feed an article such as cloth to be sewn in the front direction are connected to the external interface 13.

Figure 3:
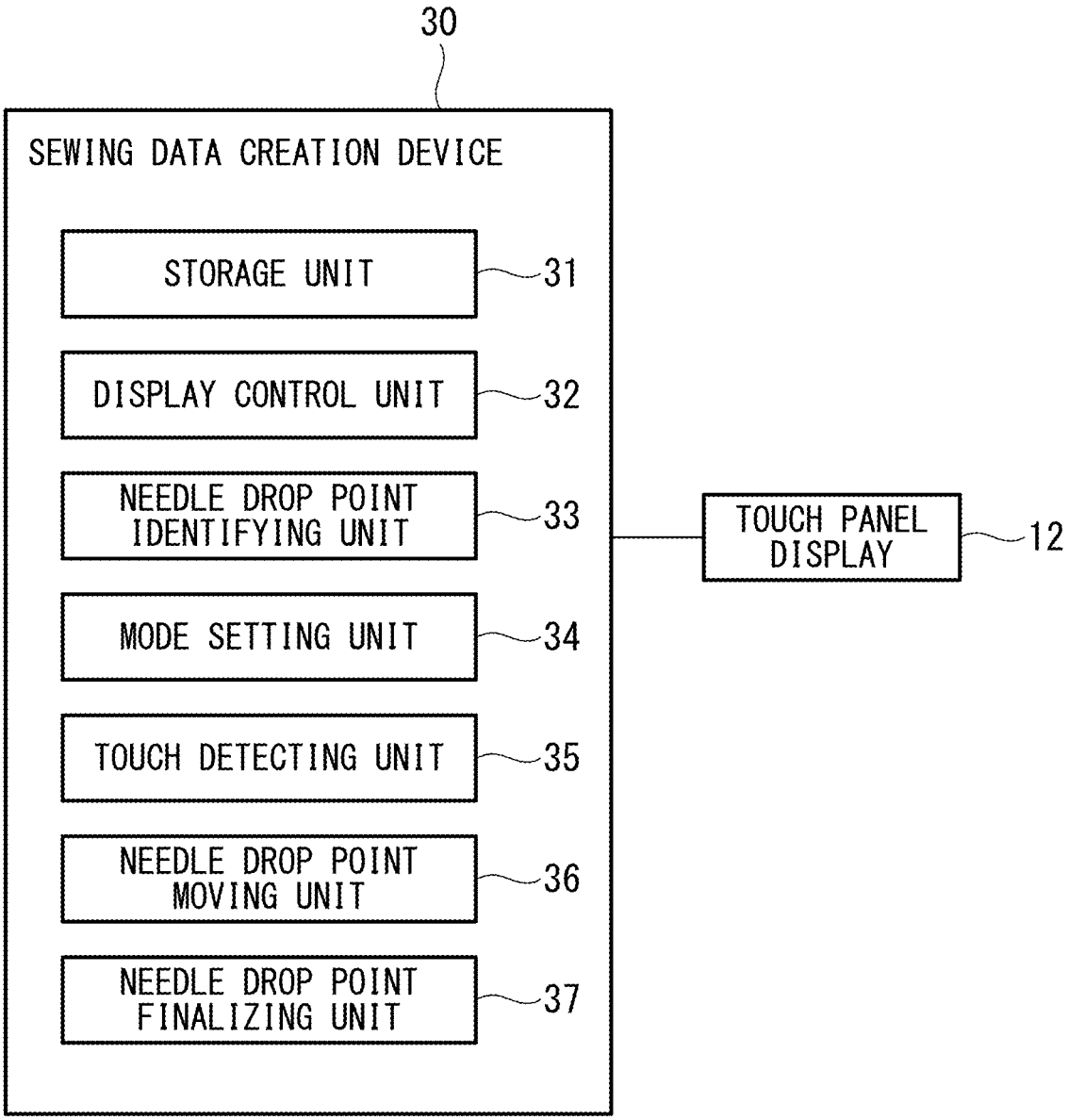
FIG. 3 is a function configuration diagram illustrating a sewing data creation function (sewing data creation device) out of various functions of the sewing machine according to one embodiment of the present disclosure.

FIG. 3 is a function configuration diagram illustrating a sewing data creation function (sewing data creation device) out of various functions of the sewing machine 1 according to the present embodiment. Note that in addition to the sewing data creation function described later, the sewing machine 1 has functions, for example, a sewing machine control function for implementing various sewing by controlling various motors such as the sewing machine motor described above. Note that, as for schemes for implementing various sewing, known techniques can be suitably employed, and the detailed description thereof will be omitted here.

A series of processes for implementing functions of respective units described later of a sewing data creation device 30 are stored in the secondary storage device 23 in a form of a program as an example, and various functions are implemented when the CPU 21 loads the program into the main storage device 22 and performs modification or computation processing on information. Note that such a program may have a form in which the program is installed in advance in the secondary storage device 23, a form in which the program is provided stored in a non-transitory computer readable storage medium, a form in which the program is delivered via a wired or wireless communication connection, or the like. Note that specific examples of the non-transitory computer readable storage medium are as described above.

As illustrated in FIG. 3, the sewing data creation device 30 includes a storage unit 31, a display control unit 32, a needle drop point identifying unit (pattern element identifying unit) 33, a mode setting unit 34, a touch detecting unit 35, a needle drop point moving unit (pattern element moving unit) 36, a needle drop point finalizing unit (pattern element finalizing unit) 37, and the like.

The storage unit 31 stores a plurality of sewing data and various data required for creating and changing sewing data. For example, the sewing data includes a plurality of pattern elements. For example, a pattern element refers to a needle drop point, an object (pattern) formed of a plurality of needle drop points connected in accordance with sewing sequence numbers, or the like. In the present embodiment, a pattern represents a concept including embroidery, stitch, zigzag sewing, letter sewing, or the like. Thus, patterns include such patterns that can be sewn not only by embroidery sewing but also by normal sewing.

Sewing data has a plurality of needle drop point records. Each needle drop point record represents information in which a position (coordinate) and a sewing sequence number of each needle drop point are associated with each other. Further, the storage unit 31 is used as a storage area for temporarily storing a needle drop point record or the like during creation and edition of sewing data.

The display control unit 32 controls display on the touch panel display 12. For example, the display control unit 32 causes an edit screen 50 to be displayed on the touch panel display 12. Further, the display control unit 32 controls the display on the touch panel display 12 in accordance with a user input operation or the like performed on the touch panel display 12.

Figure 4:
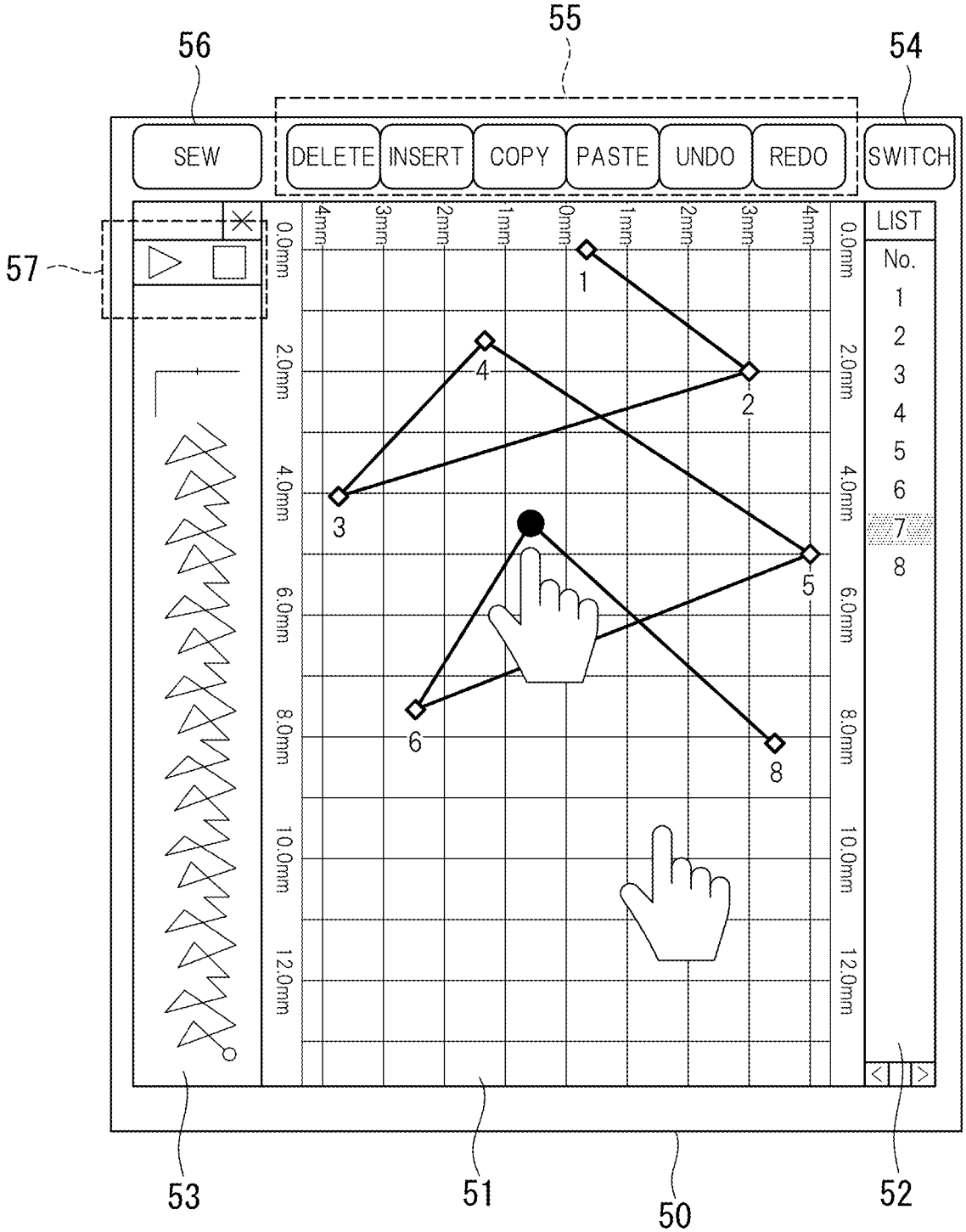
FIG. 4 is a diagram illustrating an example of an edit screen according to one embodiment of the present disclosure.

FIG. 4 is a diagram illustrating an example of the edit screen 50. As illustrated in FIG. 4, the edit screen 50 has a rendering region 51 used for displaying needle drop points (pattern elements). In the rendering region 51, a plurality of needle drop points forming sewing data are drawn. In the rendering region 51 illustrated as an example in FIG. 4, a plurality of needle drop points are drawn in an orthogonal coordinate system whose vertical axis corresponds to the feed direction (front-back direction) and horizontal axis corresponds to the amplitude direction (left-right direction). The horizontal axis represents absolute positions in the sewing machine 1, and the vertical axis represents relative parameters corresponding to feed amounts provided by the feed dog of the sewing machine 1.

Further, in the rendering region 51, information about sewing sequence numbers for respective needle drop points is displayed. In the rendering region 51 illustrated in FIG. 4, the numbers indicated near the needle drop points represent the sewing sequence numbers.

The edit screen 50 has a selection region 52 used for selecting respective needle drop points displayed in the rendering region 51. In the selection region 52, the sewing sequence numbers for respective needle drop points are displayed in the rendering region 51 as a list. For example, when description is provided with an example of the edit screen 50 illustrated in FIG. 4, the sewing sequence numbers 1 to 8 are displayed in the selection region 52, and these sewing sequence numbers 1 to 8 are associated with the needle drop points displayed in the rendering region 51, respectively. FIG. 4 illustrates a case where the seventh needle drop point is selected.

The edit screen 50 has a preview region 53 used for displaying a part or all of sewing data. Herein, the preview region 53 has a smaller scale than the rendering region 51. For example, in the rendering region 51, it is necessary to display a view enlarged to the extent that the user is able to recognize each position (coordinate) of needle drop points forming sewing data. In such a case, when the pattern is simple, it is possible to imagine the overall view of the pattern from the rendering in the rendering region 51. However, when the pattern is complex or large, it will be difficult to imagine a view of the entire pattern from the display in the rendering region 51. Even in such a case, the user is able to have a broad view of the entire pattern because the preview region 53 for displaying a scaled down view of the entire pattern is provided in the edit screen 50, which makes it easier to imagine the entire pattern and makes it possible to easily perform editing operation on the pattern.

In the edit screen 50, when each needle drop point is being adjusted by the user, this adjustment is reflected to a corresponding position of the needle drop point in the preview region 53, and this enables the user to perform fine adjustment on the needle drop point in the rendering region while grasping the overall view of the whole pattern.

Furthermore, the edit screen 50 may have a function of providing animation display in the preview region. For example, the preview region is provided with a play/stop button 57 for operations to play and stop an animation. When a play button is pressed, a view of sewing based on sewing data being edited can be displayed in the preview region with an animation. Further, the stop button is a button for stopping the animation.

Further, the edit screen 50 is provided with a switching button 54 for switching modes. For example, the sewing data creation device 30 has a plurality of modes including an input mode and a motion mode. The input mode is a mode to add a new needle drop point. Further, the motion mode is a mode to move the position of a needle drop point registered in sewing data. The switching button 54 is a button for the user to provide instructions for switching of these modes. For example, the motion mode can be switched to the input mode by the switching button 54 being pressed.

Further, the edit screen 50 is provided with function buttons 55 for efficient editing operation. The function buttons 55 include a delete button, an insert button, a copy button, a paste button, an undo button, a redo button, or the like. The delete button is a button for deleting a needle drop point selected by the user. For example, when the delete button is pressed with any needle drop point being selected, the selected needle drop point is deleted. Further, in accordance with deletion of a needle drop point, the sewing sequence numbers for the subsequent needle drop points are advanced.

Further, the copy button and the paste button are buttons for adding a needle drop point having the same position information (coordinate value) as the selected needle drop point.

The undo button is a button for cancelling the previous editing operation to recover the original state, and when continuously pressed, previous states can be continuously recovered. Further, the redo button is a button for recovering editing operation cancelled by pressing of the undo button to have the original state.

Further, the edit screen 50 is provided with a sewing execution button 56. When the sewing execution button 56 is pressed upon completion of editing operation on sewing data, the sewing data is converted into a data format to be interpreted by the sewing machine 1, and the converted sewing data is stored in the storage unit 31.

Turning back to FIG. 3, the needle drop point identifying unit 33 identifies a selected needle drop point as a target needle drop point (target pattern element) when any one of needle drop points is selected by the user in the edit screen 50 described above. For example, when any one of needle drop points is selected by the user in the selection region 52, the needle drop point identifying unit 33 identifies the selected needle drop point as a target needle drop point. Note that, without being limited to this example, it is also possible to identify a touched needle drop point as a target needle drop point when any one of the needle drop points is touched in the rendering region 51.

When a target needle drop point is identified by the needle drop point identifying unit 33, the display control unit 32 may cause the target needle drop point to be displayed in the rendering region 51 in a different manner from the remaining needle drop point(s). This enables the user to easily know which needle drop point is to be edited. The different manner may be obtained by changing the color of the target needle drop point, blinking the target needle drop point, changing the size of the target needle drop point, or the like as an example.

The mode setting unit 34 switches the mode between the input mode and the motion mode and sets the switched mode. For example, the mode setting unit 34 sets the motion mode when any one of needle drop points is selected by the user, for example, in the selection region 52. Further, the mode setting unit 34 sets the input mode when the switching button 54 is pressed by the user.

The touch detecting unit 35 detects that, in a state where the target needle drop point is identified, an instructing member comes into contact with a position in the edit screen 50 other than a position of the target needle drop point. Examples of the instructing member include the user's finger, a touch pen, and the like. Herein, the touch detecting unit 35 may detect the contact of the instructing member when the instructing member comes into contact with a position which is located within an operating region near the target needle drop point set based on a target needle drop point as a reference point and which is other than the position of the target needle drop point. This makes it possible to permit a moving operation on a target needle drop point only when a touch operation is made near the target needle drop point.

The needle drop point moving unit 36 moves the position of a target needle drop point in the rendering region 51 to be linked with the motion of the instructing member that is in contact with the edit screen 50 (for example, the rendering region 51).

The needle drop point finalizing unit 37 finalizes the position of a target needle drop point when the contact of the instructing member is no longer detected.

Next, a series of processes performed by the touch detecting unit 35, the needle drop point moving unit 36, and the needle drop point finalizing unit 37 described above will be described with reference to FIG. 5.

Figure 5:
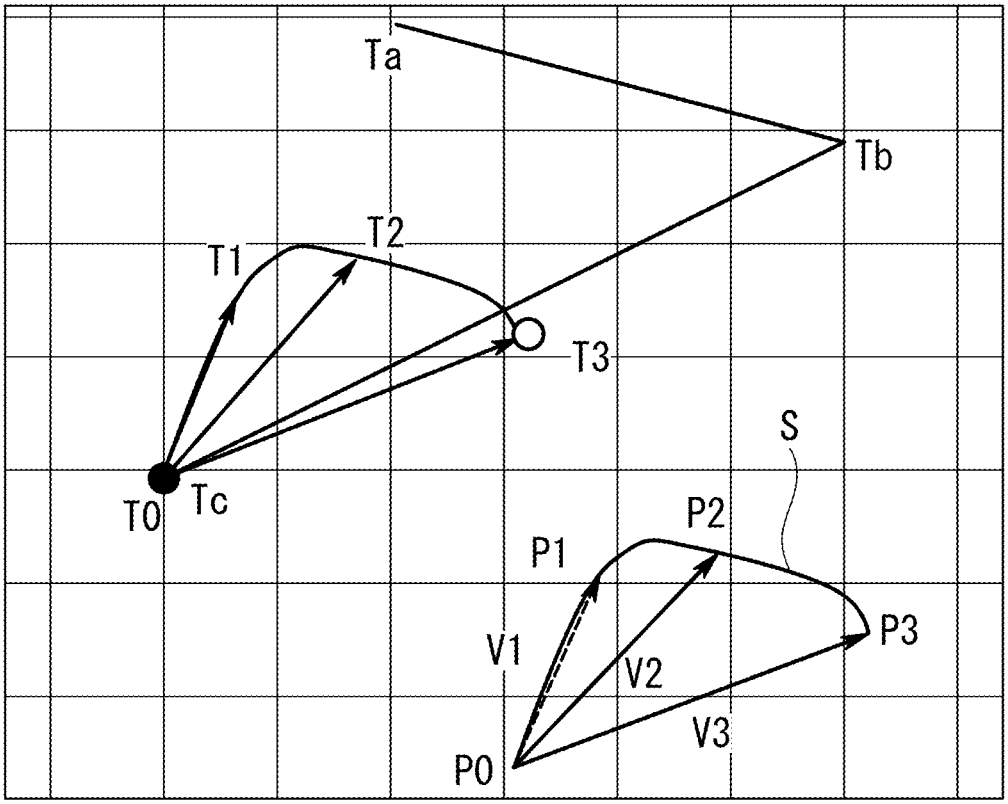
FIG. 5 is a diagram illustrating a series of processes performed by a touch detecting unit, a needle drop point moving unit, and a needle drop point finalizing unit according to one embodiment of the present disclosure.

For example, as illustrated in FIG. 5, it is assumed that, in a state where the needle drop point Tc out of the needle drop points Ta, Tb, and Tc is identified as a target needle drop point, the user touches (contacts with) the coordinate P0 by its finger, moves the finger as with the trace S to the coordinate P3, and then releases the finger therefrom.

In such a case, the contact of the finger at the coordinate P0 is detected by the touch detecting unit 35. Further, the touch detecting unit 35 determines the coordinate of the touch position until the contact of the finger is no longer detected. For example, the touch detecting unit 35 determines the coordinate based on a signal from a touch sensor or the like of the touch panel display 12.

The needle drop point moving unit 36 calculates a vector from the coordinate P0 at a predetermined time interval based on a positional relationship between a coordinate of a finger repeatedly detected by the touch detecting unit 35 and the coordinate P0 of the initial touch position. For example, the needle drop point moving unit 36 detects vectors defined by the distance and the direction from the coordinate P0 (for example, V1, V2, V3, and the like) at a predetermined time interval based on the coordinate P0 as a reference point at which the initial contact of the finger is detected by the touch detecting unit 35. The needle drop point moving unit 36 then adds the detected vectors (V1, V2, V3, and the like) to the coordinate T0 of the target needle drop point Tc and thereby moves the corresponding needle drop point Tc as needed to be linked with the motion of the user's finger.

Once the user's finger is released at the coordinate P3, the needle drop point finalizing unit 37 finalizes the coordinate T3 of the corresponding needle drop point when the finger is released. Accordingly, the target needle drop point Tc moves from the coordinate TO via the coordinates T1, T2 to the coordinate T3 while drawing the same trace as the motion of the user's finger, and the position is finalized at the coordinate T3.

Figure 6:
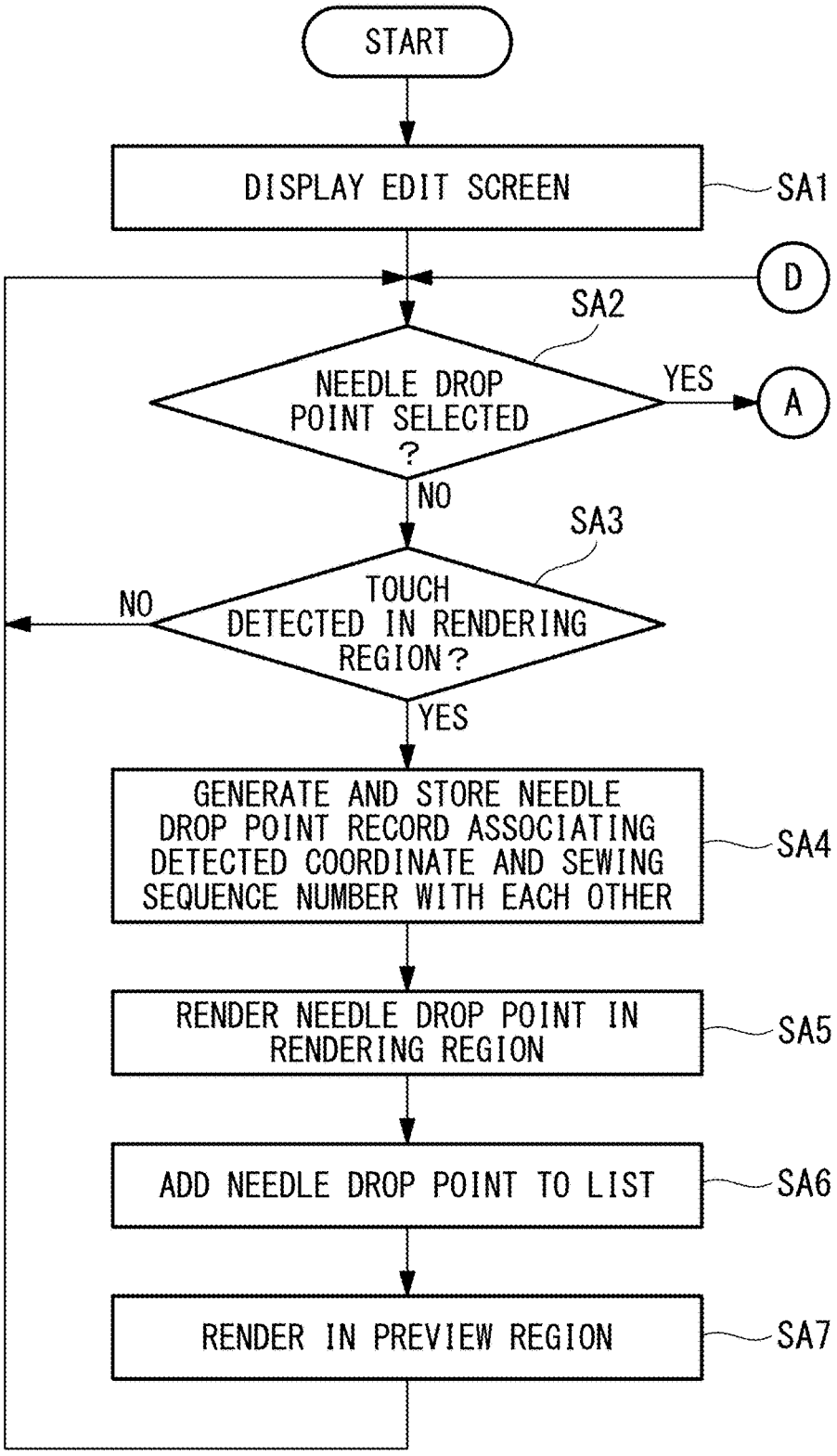
FIG. 6 is a flowchart illustrating an example of a processing procedure of a sewing data creation method according to one embodiment of the present disclosure.
Figure 7:
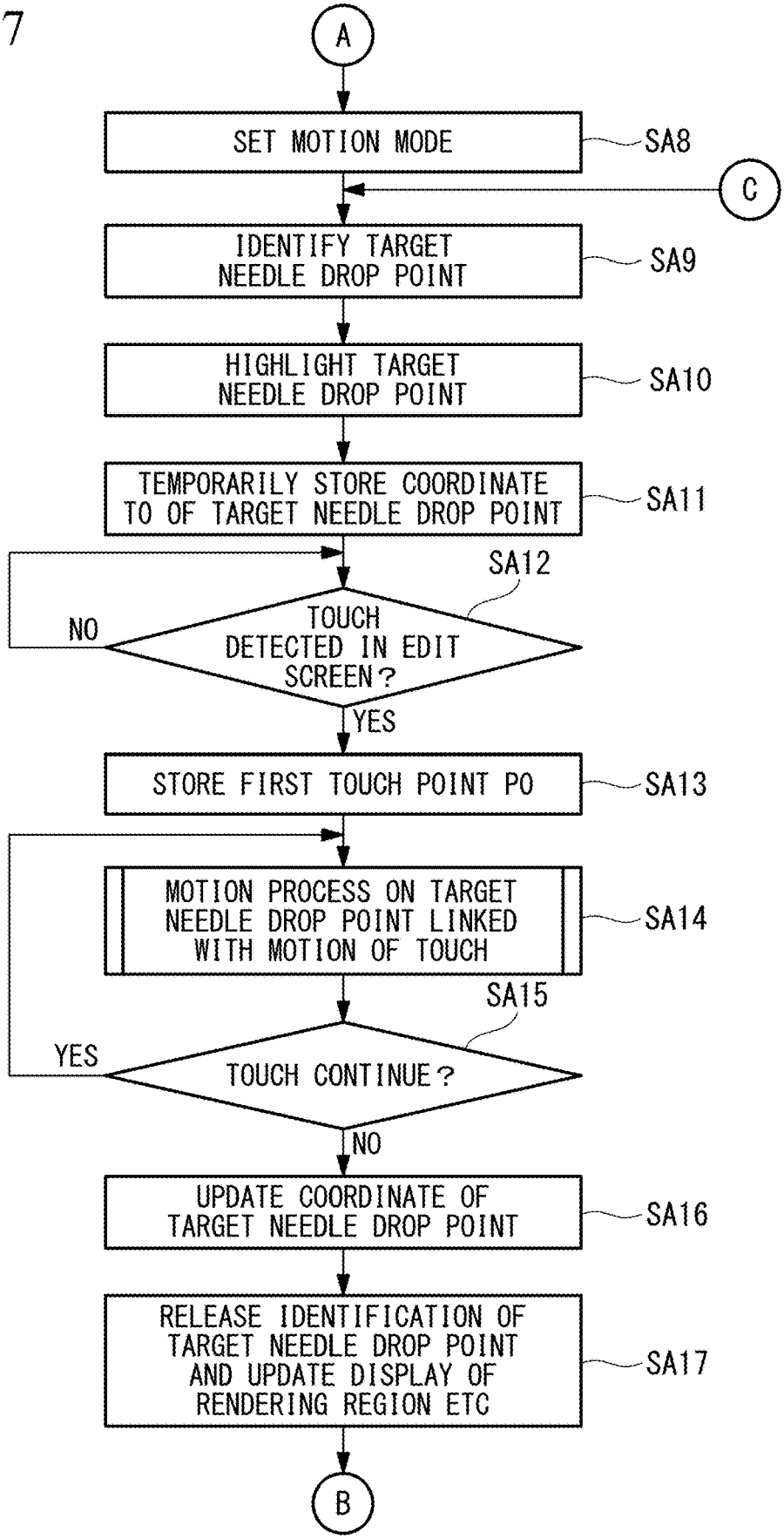
FIG. 7 is a flowchart illustrating an example of the processing procedure of the sewing data creation method according to one embodiment of the present disclosure.
Figure 8:
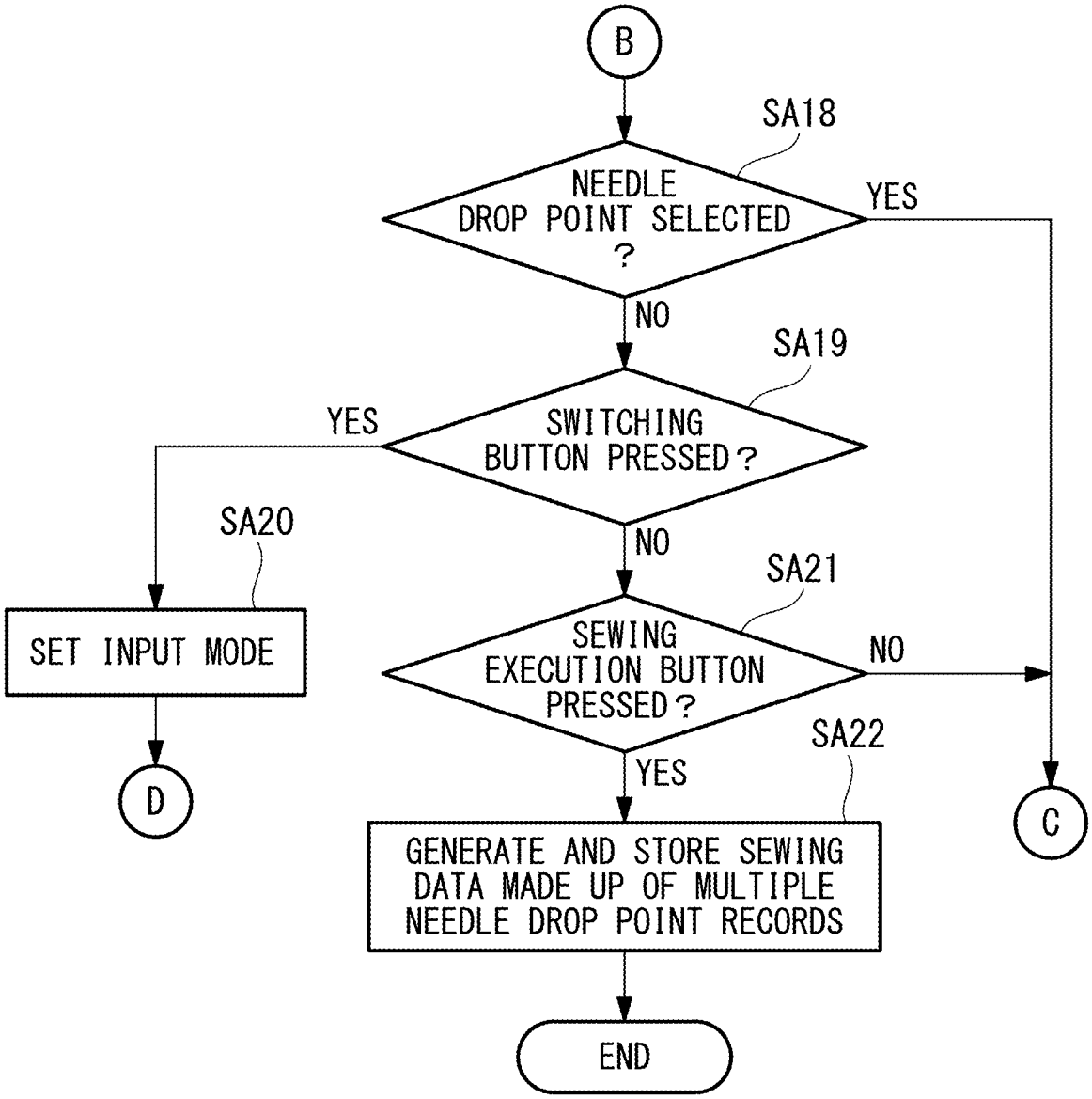
FIG. 8 is a flowchart illustrating the example of the processing procedure of the sewing data creation method according to one embodiment of the present disclosure.

Next, a sewing data creation method according to the present embodiment will be described with reference to the drawings. FIG. 6 to FIG. 8 are flowcharts illustrating an example of the processing procedure of the sewing data creation method according to the present embodiment. A series of processes described below is stored in the secondary storage device 23 in a form of a program (a sewing data generating program) as an example, and the following processes are performed when the CPU 21 loads this program into the main storage device 22 and performs modification or computation processing on information.

For example, the sewing data creation process according to the present embodiment is handled as one of various functions of the sewing machine 1. For example, in response to the user's selection of a menu such as "stitch creation function" out of various menus displayed on the touch panel display 12, the following process is performed by the sewing data creation device 30.

First, the edit screen 50 is displayed on the touch panel display 12 (SA1). This edit screen 50 is set to the input mode by default. At this time, no needle drop point is set. Thus, a blank is displayed in each of the rendering region 51, the selection region 52, and the preview region 53.

Subsequently, in the selection region 52, it is determined whether or not a needle drop point is selected (SA2). At this time, as described above, no needle drop point is registered in the selection region 52. Thus, NO is determined, and it is determined whether or not a touch is detected in the rendering region 51 (SA3). As a result, if no touch is detected in the rendering region 51 (NO in SA3), the process returns to step SA2 and repeats the processes described above.

In contrast, if a touch is detected in the rendering region 51 (YES in SA3), a needle drop point record in which a coordinate where a touch is detected and a sewing sequence number are associated with each other is generated and stored in the storage unit 31 (SA4). Subsequently, based on the stored needle drop point record, a needle drop point is rendered in the rendering region 51 (SA5), the sewing sequence number of the needle drop point (list) is added to the selection region 52 (SA6), the needle drop point is rendered in the preview region (SA7), and the process returns to step SA2.

Accordingly, for example, in response to the user's touch of desired positions one after another in the rendering region 51 in the input mode, needle drop points are sequentially rendered at the touched positions in the rendering region 51, and respective sewing sequence numbers corresponding to the needle drop points are displayed in the selection region 52. Further, respective needle drop points will also be displayed one after another in the preview region 53. Further, the needle drop point records for respective needle drop points are generated and stored in the storage unit 31.

Once a sewing sequence number displayed in the selection region 52 is selected by the user in a state where at least one needle drop point is displayed in the rendering region 51 in such a way, "YES" is determined in step SA2, and the process proceeds to step SA8 of FIG. 7.

In step SA8, the motion mode is set (SA8), subsequently, a needle drop point corresponding to the selected sewing sequence number is identified as a target needle drop point (SA9), and the target needle drop point is displayed in a different manner (for example, a different color) from the remaining needle drop point(s) and thereby highlighted in the rendering region 51 (SA10).

Subsequently, the coordinate T0 of the target needle drop point is acquired from the needle drop point record stored in the storage unit 31 and temporarily stored (SA11).

Next, it is determined whether or not a touch on the edit screen 50 is detected (SA12). As a result, if no touch is detected (NO in SA12), the process waits until a touch is detected. If a touch is detected (YES in SA12), the coordinate P0 of the first touch is stored (SA13), and a motion process linked with the motion of the touch is performed on the target needle drop point (SA14). In this motion process, the coordinate T0 of the target needle drop point temporarily stored in step SA11 is used. Note that, since the motion process is as described above with FIG. 5, the detailed description thereof will be omitted here.

Next, it is determined whether or not the touch continues (SA15). If the touch continues (YES in SA15), the process returns to SA14 and continuously performs the motion process. In contrast, if the touch is no longer detected because the user releases its finger (NO in SA15), the coordinate T0 in the needle drop point record of the target needle drop point stored in the storage unit 31 is updated to the current coordinate Tn, and thereby the needle drop point record is updated (SA16). Subsequently, in response to release of identification of the target needle drop point, the highlighting in the rendering region 51 is stopped to return to the original state, and the display of the preview region is updated based on the updated needle drop point record (SA17).

Next, in the selection region 52, it is determined whether or not a needle drop point is selected again (SA18 of FIG. 8). As a result, if a needle drop point is selected (YES in SA18), the process returns to step SA9 of FIG. 7 and repeats the subsequent processes. In contrast, if no needle drop point is selected (NO in SA18), it is determined whether or not the switching button 54 is pressed (SA19). As a result, if the switching button 54 is pressed (YES in SA19), the input mode is set (SA20), and the process returns to step SA2 of FIG. 6 and repeats the subsequent processes. Further, if the switching button 54 is not pressed (NO in SA19), it is determined whether or not the sewing execution button 56 is pressed (SA21). As a result, if the sewing execution button 56 is not pressed (NO in SA21), the process returns to step SA9 of FIG. 8 and repeats the subsequent processes. In contrast, if the sewing execution button 56 is pressed (YES in SA21), sewing data made up of a plurality of needle drop point records stored in the storage unit 31 is generated, the generated sewing data is converted into a format that can be interpreted by the sewing machine 1, the converted sewing data is stored in the storage unit 31 (SA22), and the present process ends.

In response to execution of the sewing data creation process described above, for example, in response to the user's touch of the rendering region 51 in the input mode, a needle drop point can be set at the touched position. When the user touches the rendering region 51 one after another along a view of a pattern intended to create, a plurality of needle drop points are rendered in the rendering region 51, and sewing sequence numbers corresponding to respective needle drop points are displayed in the selection region 52. Note that, since each needle drop point can be positioned in detail in the motion mode, it is sufficient to touch approximate positions in the input mode.

Further, when intending to adjust the position of any of the needle drop points, the user selects a sewing sequence number corresponding to a desired needle drop point in the selection region 52. Accordingly, a target needle drop point selected by the user is highlighted in the rendering region 51. The user touches any position in the rendering region 51, in other words, touches a position not overlapping the target needle drop point in the rendering region 51 and moves the finger while touching the screen to move the target needle drop point to a desired position, and then releases the finger. This enables easy adjustment of the coordinate of the target needle drop point. The coordinate of the moved target needle drop point is read, and the coordinate of the needle drop point record of this needle drop point is updated.

Then, after creating a desired pattern by inputting the needle drop point in the input mode, moving the needle drop point in the motion mode, and the like, the user may press the sewing execution button 56. Accordingly, sewing data is created based on each created needled drop point record and stored in the storage unit 31.

Note that, although the case where the user creates sewing data from scratch in the edit screen 50 has been described above, the disclosure is not limited thereto. For example, it is also possible to create new sewing data or update pre-stored sewing data by reading sewing data for a desired pattern pre-stored in the storage unit 31 and editing one or more needle drop points of the read sewing data in the edit screen 50.

As described above, according to the sewing data creation device 30, the program, and the sewing machine 1 of the present embodiment, the embodiment includes: the display control unit 32 configured to render a plurality of needle drop points of the sewing data on the coordinate system and cause an edit screen 50, which includes a rendering region used for displaying information about sewing sequence numbers for respective needle drop points, to be displayed on the touch panel display 12; the needle drop point identifying unit 33 configured to, when any one of the needle drop points is selected by the user, identify the selected needle drop point as a target needle drop point; the touch detecting unit 35 configured to detect contact of a finger with the rendering region 51 with the target needle drop point being identified; the needle drop point moving unit 36 configured to move the target needle drop point to be linked with motion of the finger; and the needle drop point finalizing unit 37 configured to, when the contact of the finger is no longer detected, finalize the current target needle drop point.

This enables the user to move a target needle drop point to a desired position by touching and moving any position in the rendering region by its finger. Accordingly, it is no longer necessary to display the eight-direction cursor button in the edit screen which is conventionally required, and it is possible to set the rendering region 51 wider in which the user performs edition. This makes it possible to effectively use the entire edit screen. Furthermore, the user is able to move a target needle drop point to a desired position by touching any position in the rendering region and moving the finger while maintaining the touching state. This can also eliminate the inconvenience in which a target needle drop point is hidden by the finger and is not seen. According to the above, usability in creation and edition of sewing data can be improved.

Furthermore, the edit screen 50 is provided with the preview region 53 used for rendering sewing data in which needle drop points are connected along sewing sequence numbers. This enables the user to easily know the overall view of a pattern by confirming a preview displayed in the preview region 53.

Although the present disclosure has been described above with reference to the embodiment, the technical scope of the present disclosure is not limited to the scope defined by the above embodiment. Various modification or improvement can be applied to the above embodiment within the scope not departing from the spirit of the disclosure, and such modified or improved forms also falls in the technical scope of the present disclosure. Further, the procedure of the method described in the above embodiment is a mere example, an unnecessary step may be deleted, a new step may be added, or the processing order may be exchanged within the scope not departing from the spirit of the present disclosure.

For example, the case where the sewing data creation device (sewing data creation function) 30 is mounted on the sewing machine 1 has been described in the above embodiment, but the disclosure is not limited thereto. For example, the sewing data creation device 30 may be provided to the user in a form of an application program. For example, such an application program may be installed in an information processing device (for example, a laptop PC, a desktop PC, a tablet terminal, a smartphone, or the like) possessed by the user and thereby enable the user to create or edit sewing data. For example, the application program may be provided so as to be downloadable via a network or may be provided stored in a computer readable storage medium.

Further, sewing data created in the information processing device may be transmitted to the sewing machine 1 via the network or may be stored in a server or the like on a network accessible by the sewing machine 1. When such sewing data is stored on the server, the sewing machine 1 may access the server at a predetermined timing, download the sewing data from the server, and use the downloaded sewing data.

Figure 9:
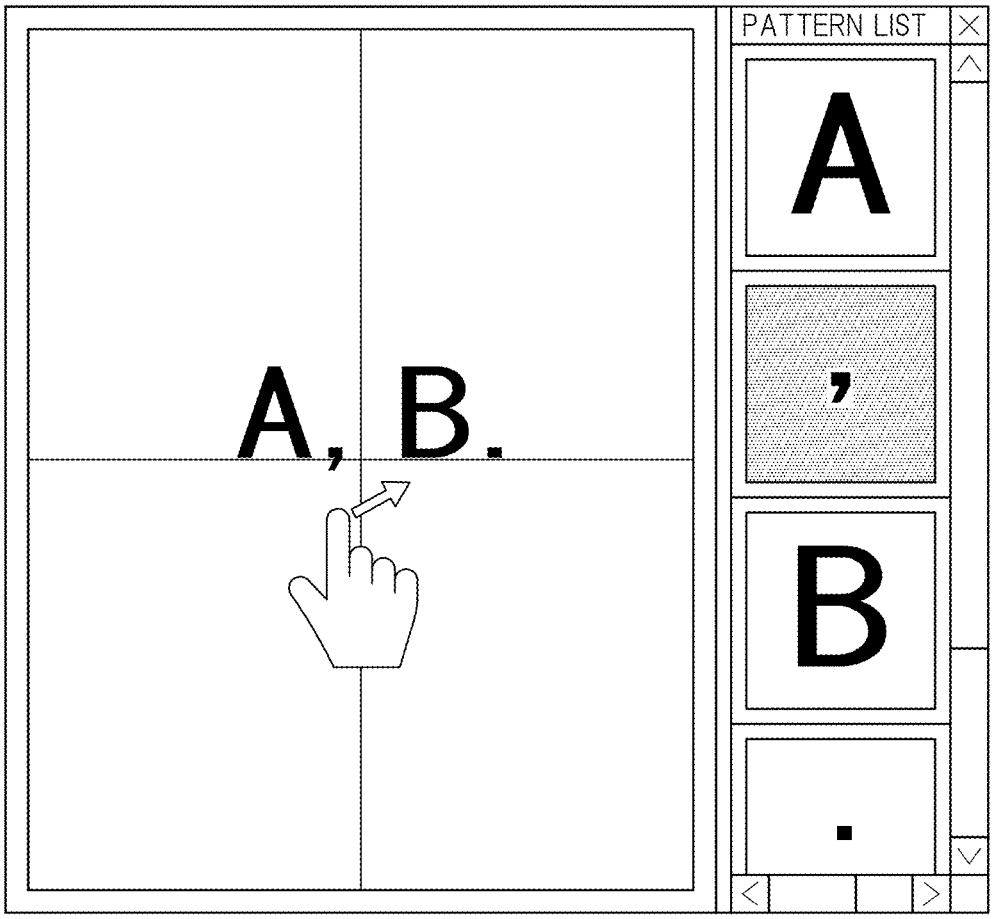
FIG. 9 is a diagram illustrating the example of an edit screen according to another embodiment of the present disclosure.

Further, the case where each needle drop point (pattern element) forming sewing data is edited in the edit screen 50 has been described in the above embodiment, but the editable unit is not limited thereto. For example, as illustrated in FIG. 9, such a configuration may be employed that enables selection on an object basis where the object is formed by connecting a plurality of needle drop points in accordance with sewing sequence numbers and allows motion of a target object (target pattern element) to a desired position in the rendering region 51 in accordance with the same scheme as described in the above embodiment.

LIST OF REFERENCE NUMERALS

1: sewing machine
12: touch panel display
13: external interface
20: processing circuit
21: CPU
22: main storage device
23: secondary storage device
30: sewing data creation device
31: storage unit
32: display control unit
33: needle drop point identifying unit (pattern element identifying unit)
34: mode setting unit
35: touch detecting unit
36: needle drop point moving unit (pattern element moving unit)
37: needle drop point finalizing unit (pattern element finalizing unit)
50: edit screen
51: rendering region
52: selection region
53: preview region
54: switching button
55: function button
56: sewing execution button

What is claimed is:

1. A sewing data creation device used in a sewing machine and configured to create sewing data having a pattern element, the sewing data creation device comprising:

a display control unit configured to cause an edit screen to be displayed on a touch panel display, the edit screen including a rendering region used for displaying the pattern element;

a pattern element identifying unit configured to, when the pattern element is selected by a user, identify the selected pattern element as a target pattern element;

a touch detecting unit configured to detect contact of an instructing member with any position in the edit screen other than a position of the target pattern element with the target pattern element being identified;

a pattern element moving unit configured to move the position of the target pattern element in the rendering region to be linked with motion of the instructing member that is in contact with the edit screen; and a pattern element finalizing unit configured to, when the contact of the instructing member is no longer detected, finalize the position of the target pattern element.

2. The sewing data creation device according to claim 1, wherein the sewing data includes a plurality of pattern elements; and wherein the display control unit causes information to be displayed in the rendering region, the information being about the plurality of pattern elements and respective sewing sequence numbers for the pattern elements.

3. The sewing data creation device according to claim 2, wherein the edit screen includes a selection region used for selecting each of the pattern elements displayed in the rendering region, wherein when any one of the pattern elements is selected by a user in the selection region, the pattern element identifying unit identifies the selected pattern element as a target pattern element, and wherein the display control unit causes the target pattern element in the rendering region to be displayed in a different manner from another pattern element.

4. The sewing data creation device according to claim 3, wherein respective sewing sequence numbers for the pattern elements are displayed as a list in the selection region.

5. The sewing data creation device according to claim 3 further comprising a mode setting unit including an input mode to add a new pattern element and a motion mode to move a position of an existing pattern element, the mode setting unit being configured to set the motion mode when any one of the pattern elements is selected in the selection region.

6. The sewing data creation device according to claim 1, wherein the edit screen includes a preview region used for displaying a part or all of the sewing data, and the preview region has a smaller scale than the rendering region.

7. The sewing data creation device according to claim 1, wherein the pattern element is a needle drop point or an object formed by connecting a plurality of needle drop points in accordance with sewing sequence numbers.

8. The sewing data creation device according to claim 1, wherein the pattern element comprises a needle drop point or a pattern formed of a plurality of needle drop points connected in accordance with sewing sequence numbers.

9. The sewing data creation device according to claim 1, wherein the pattern represents a concept including embroidery, stitch, zigzag sewing, or letter sewing.

10. The sewing data creation device according to claim 1, wherein the rendering region is configured to draw a plurality of needle drop points in an orthogonal coordinate system whose vertical axis corresponds to the feed direction (front-back direction) and horizontal axis corresponds to the amplitude direction (left-right direction).

11. The sewing data creation device according to claim 1, wherein the instructing member is a user's finger.

12. The sewing data creation device according to claim 1, wherein when the instructing member is moved, the position of the target pattern element in the rendering region can be moved in conjunction with the movement of the instructing member.

13. The sewing data creation device according to claim 1, wherein respective sewing sequence numbers for the pattern elements are displayed as a list in the edit screen.

14. The sewing data creation device according to claim 1, wherein respective sewing sequence numbers for the pattern elements are displayed.

15. A sewing machine comprising the sewing data creation device according to claim 1.

16. The sewing machine according to claim 15, further comprising a storage device storing a series of process for implementing functions of the sewing data creation device.

17. A non-transitory computer readable storage medium storing a control program of the sewing data creation device so as to control the sewing data creation device according to claim 1.

* * * * *